US006883862B1

(12) United States Patent
Yao

(10) Patent No.: US 6,883,862 B1
(45) Date of Patent: Apr. 26, 2005

(54) FOLDABLE CHAIR ASSEMBLY

(76) Inventor: King-Yurn Yao, 4F, No. 98, Zhuang Yi St., Taoyuan (TW)

( * ) Notice: Subject to any disclaimer, the term of this patent is extended or adjusted under 35 U.S.C. 154(b) by 0 days.

(21) Appl. No.: 10/690,733

(22) Filed: Oct. 21, 2003

(51) Int. Cl.[7] ..... A47C 4/00
(52) U.S. Cl. ..... 297/16.1
(58) Field of Search ..... 297/56, 24, 25, 297/42, 16.1, 29, 47, 51; 108/132, 120, 127, 108/118

(56) References Cited

U.S. PATENT DOCUMENTS 939,963 A * 11/1909 Anderson ..... 108/120
2,587,010 A * 2/1952 Thompson ..... 108/171
3,157,136 A * 11/1964 Moody ..... 108/155
3,649,074 A * 3/1972 McDonald et al. ..... 297/153
3,797,695 A * 3/1974 Law ..... 297/188.1
4,061,305 A * 12/1977 Beekenkamp ..... 248/432
4,177,737 A * 12/1979 Brickman ..... 108/11
5,584,254 A * 12/1996 Williams ..... 108/118
6,332,646 B1 * 12/2001 Tseng ..... 297/16.1

* cited by examiner

*Primary Examiner*—Milton Nelson, Jr.
(74) *Attorney, Agent, or Firm*—Alan D. Kamrath; Nikolai & Mersereau, P.A.

(57) ABSTRACT

A foldable chair assembly includes a support frame, a first support leg, a second support, and two opposite resting members each pivotally mounted between the mediate portion of the first support leg and the mediate portion of the second support leg. Thus, the foldable chair assembly is folded and expanded easily and conveniently, thereby facilitating the user using the foldable chair assembly. In addition, when the foldable chair assembly is expanded, the limit rod is rested on the mediate portion of the second support leg, so that the first support leg is combined with the second support leg so as to support the support frame and the seat rigidly and stably.

9 Claims, 5 Drawing Sheets

FOLDABLE CHAIR ASSEMBLY

BACKGROUND OF THE INVENTION

1. Field of the Invention

The present invention relates to a foldable chair assembly, and more particularly to a foldable chair assembly that is folded and expanded easily and conveniently, thereby facilitating the user using the foldable chair assembly.

2. Description of the Related Art

A conventional chair has a fixed size and cannot be folded, thereby occupying larger space when not in use. The foldable chair can be expanded when in use and can be folded when not in use so as to save the space, thereby facilitating the user storing the conventional foldable chair. However, the conventional foldable chair tends to be folded unintentionally, thereby causing danger to the user.

SUMMARY OF THE INVENTION

The primary objective of the present invention is to provide a foldable chair assembly that is folded and expanded easily and conveniently, thereby facilitating the user using the foldable chair assembly.

Another objective of the present invention is to provide a foldable chair assembly, wherein when the foldable chair assembly is disposed at the normally stretched state, each of the two resting members is located above an intersection between the first support leg and the second support leg, and the bent portion of each of the two resting members is directed upward.

A further objective of the present invention is to provide a foldable chair assembly, wherein when the foldable chair assembly is disposed at the normally stretched state, the limit rod of the first support leg is rested on the mediate portion of the second support leg, so that the first support leg is combined with the second support leg so as to support the support frame and the seat rigidly and stably.

A further objective of the present invention is to provide a foldable chair assembly, wherein when the foldable chair assembly is disposed at the folded state, each of the two resting members is located below an intersection between the first support leg and the second support leg, and the bent portion of each of the two resting members is directed downward.

In accordance with the present invention, there is provided a foldable chair assembly, comprising:

a support frame;

a first support leg having an upper portion pivotally mounted on a bottom of the support frame;

a second support leg having an upper portion pivotally mounted on the bottom of the support frame; and two opposite resting members each pivotally mounted between a mediate portion of the first support leg and a mediate portion of the second support leg.

Further benefits and advantages of the present invention will become apparent after a careful reading of the detailed description with appropriate reference to the accompanying drawings.

DETAILED DESCRIPTION OF THE INVENTION

Figure 1:
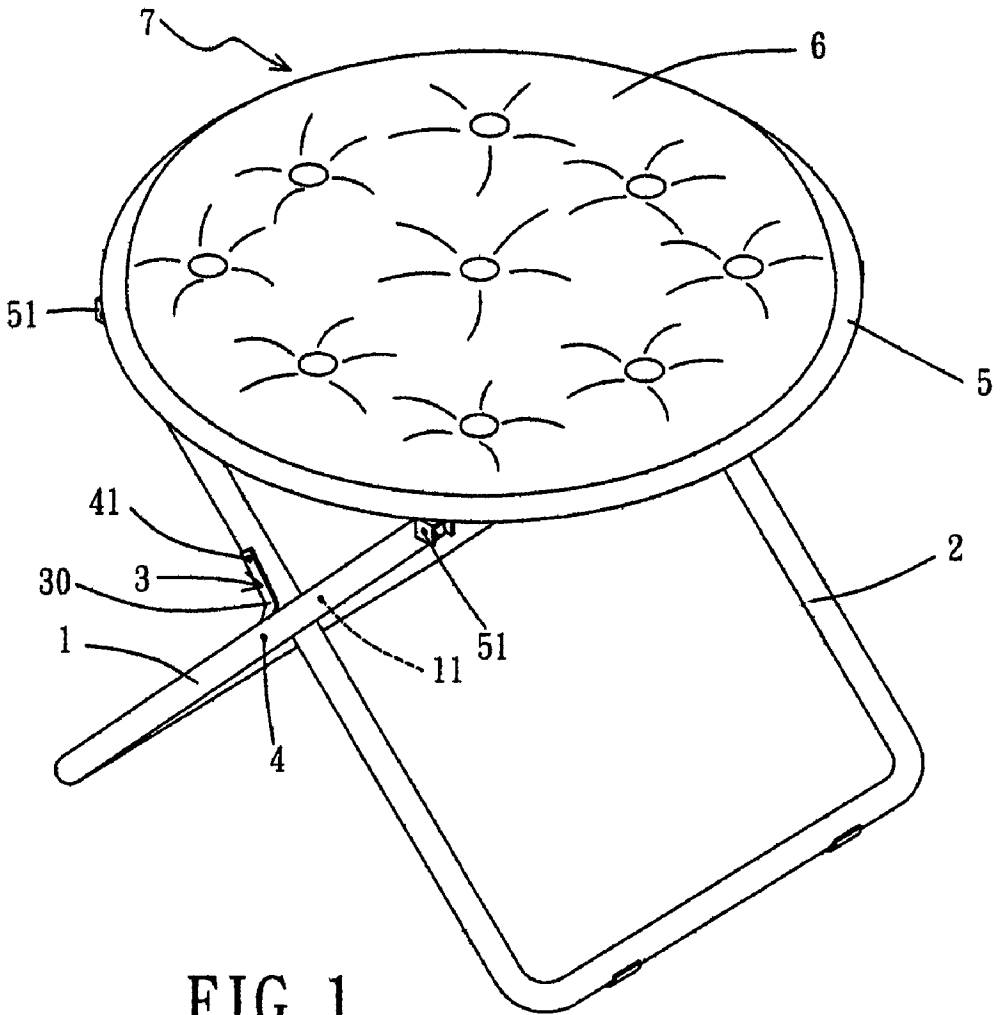
FIG. 1 is a perspective view of a foldable chair assembly in accordance with the preferred embodiment of the present invention.

Referring to the drawings and initially to FIGS. 1–4, a foldable chair assembly 7 in accordance with the preferred embodiment of the present invention comprises a support frame 5, a first support leg 1 having an upper portion pivotally mounted on a bottom of the support frame 5, a second support leg 2 having an upper portion pivotally mounted on the bottom of the support frame 5, and two opposite resting members 3 each pivotally mounted between a mediate portion of the first support leg 1 and a mediate portion of the second support leg 2. Preferably, each of the first support leg 1 and the second support leg 2 is substantially U-shaped.

The bottom of the support frame 5 is provided with a plurality of pivot ears 51 for pivoting the upper portion of each of the first support leg 1 and the second support leg 2 by a plurality of pivot pins 52. The foldable chair assembly 7 further comprises a seat 6 mounted on the support frame 5.

Figure 2A:
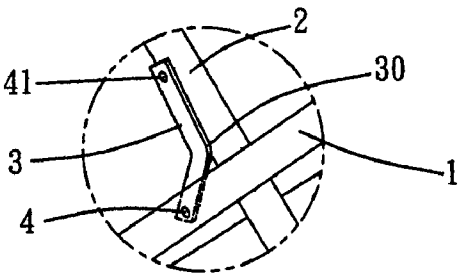
FIG. 2A is a partially enlarged view of the foldable chair assembly as shown in FIG. 2.
Figure 2B:
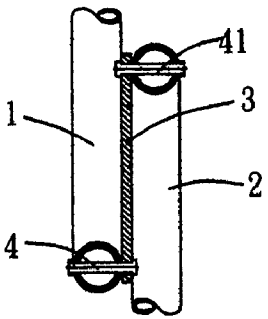
FIG. 2B is a plan cross-sectional view of the foldable chair assembly as shown in FIG. 2A.

As shown in FIGS. 2A and 2B, each of the two resting members 3 is substantially V-shaped and has a first end pivotally mounted on an inner side of the first support leg 1 by a first pin 4 and a second end pivotally mounted on an outer side of the second support leg 2 by a second pin 41. In addition, the mediate portion of the first support leg 1 is provided with a limit rod 11 rested on the mediate portion of the second support leg 2. Preferably, the limit rod 11 of the first support leg 1 is located above the first pin 4 at the first end of each of the two resting members 3.

Figure 2:
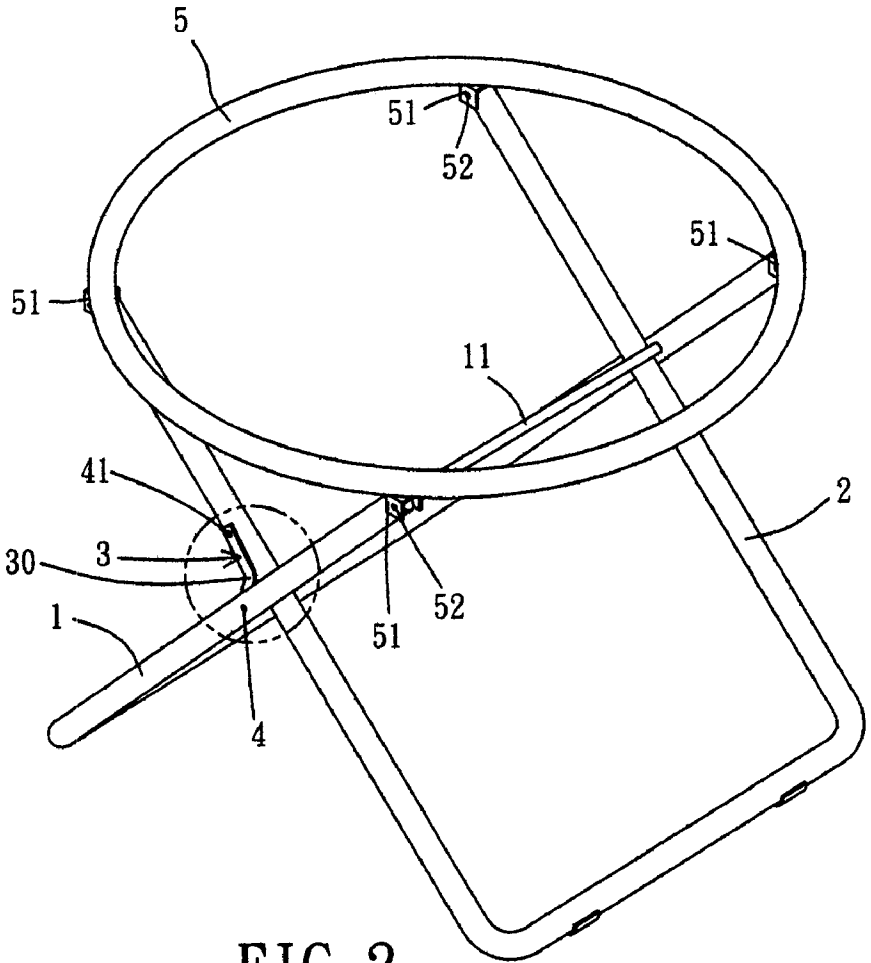
FIG. 2 is a partially perspective view of the foldable chair assembly in accordance with the preferred embodiment of the present invention.
Figures 4, 5, 6, 7:
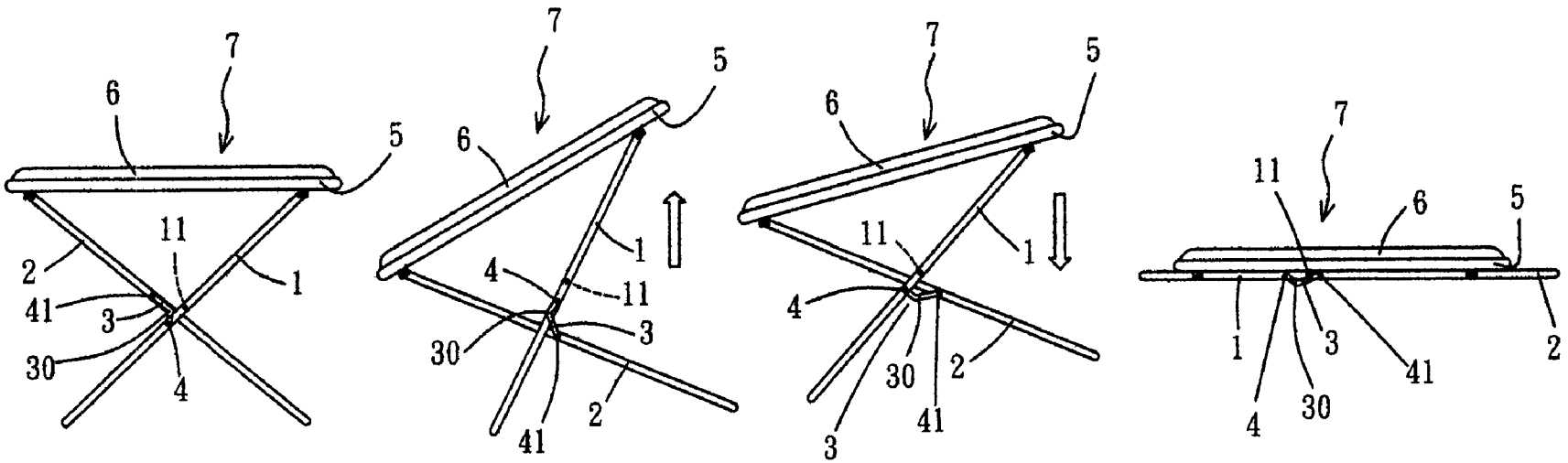
FIG. 4 is a plan view of the foldable chair assembly as shown in FIG. 1.
FIG. 5 is a schematic operational view of the foldable chair assembly as shown in FIG. 4.
FIG. 6 is a schematic operational view of the foldable chair assembly as shown in FIG. 5.
FIG. 7 is a schematic operational view of the foldable chair assembly as shown in FIG. 6.

As shown in FIGS. 2 and 4, each of the two resting members 3 has a mediate portion formed with a bent portion 30 facing upward and directed toward the upper portion of the first support leg 1.

Figure 3:
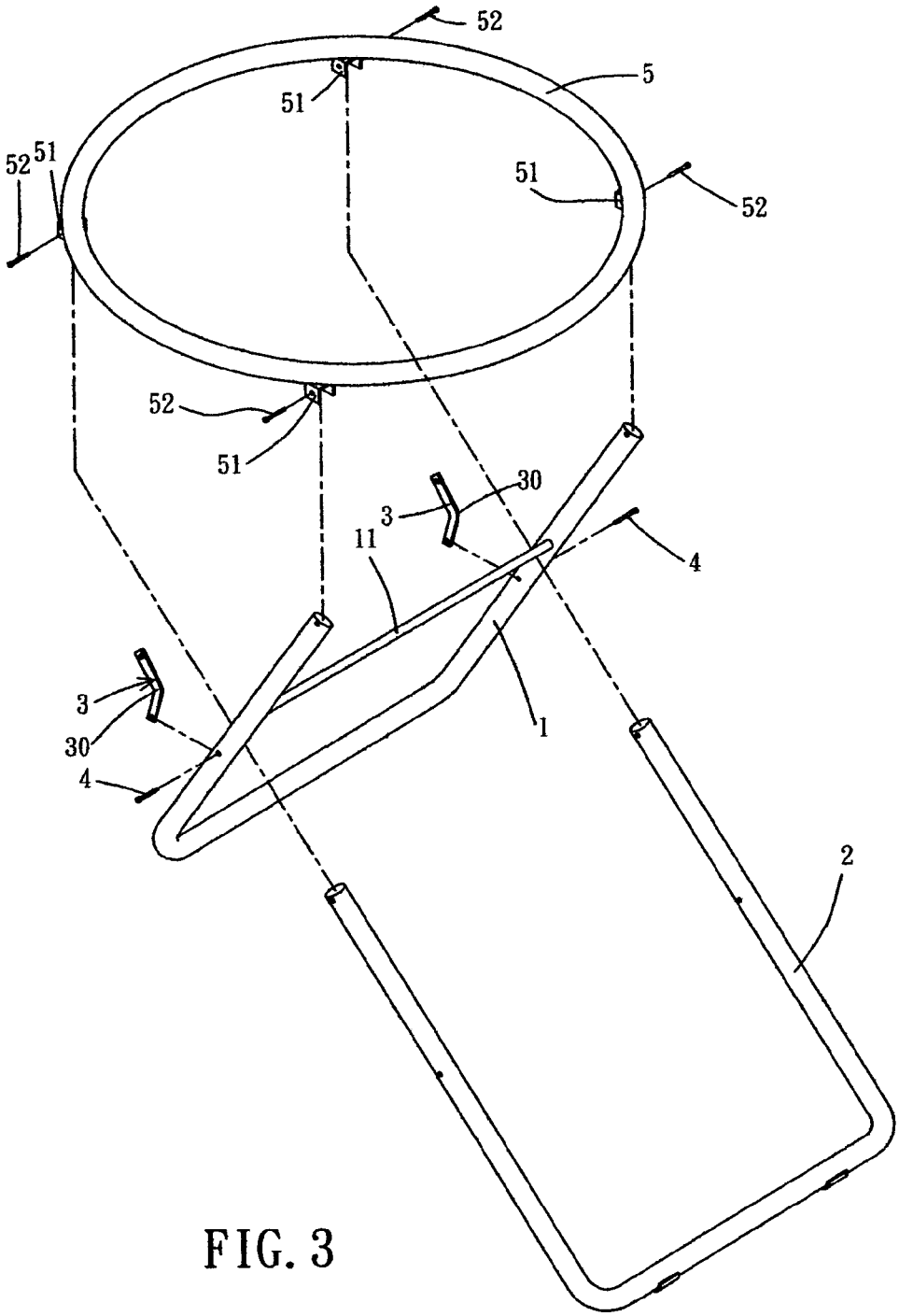
FIG. 3 is an exploded perspective view of the foldable chair assembly as shown in FIG. 2.

Referring to FIGS. 4–7 with reference to FIGS. 1–3, when the user wishes to fold the foldable chair assembly 7, the limit rod 11 of the first support leg 1 is rested on the mediate portion of the second support leg 2 as shown in FIG. 4, so that the first support leg 1 is combined with the second support leg 2 so as to support the support frame 5 and the seat 6 rigidly and stably. Then, the support frame 5 is pulled upward to move the first support leg 1 upward, so that the first support leg 1 and the limit rod 11 are moved upward and each of the two resting members 3 are pivoted about the second pin 41 in the counterclockwise direction to move from the position as shown in FIG. 4 to the position as shown in FIG. 5. Then, the support frame 5 is pushed downward to move the first support leg 1 downward, so that the first support leg 1 and the limit rod 11 are moved downward and each of the two resting members 3 are pivoted about the second pin 41 in the counterclockwise direction to move from the position as shown in FIG. 5 to the position as shown in FIG. 6. At this time, each of the two resting members 3 is located below an intersection between the first support leg 1 and the second support leg 2 and is directed downward. Then, the support frame 5 is pushed downward successively to move the first support leg 1 downward, so that the first support leg 1 and the second support leg 2 are pressed toward each other and are folded below the support frame 5 as shown in FIG. 7, thereby folding the foldable chair assembly 7.

Figure 11:
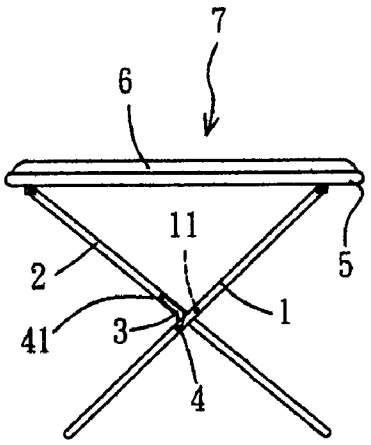
FIG. 11 is a schematic operational view of the foldable chair assembly as shown in FIG. 10.
Figure 10:
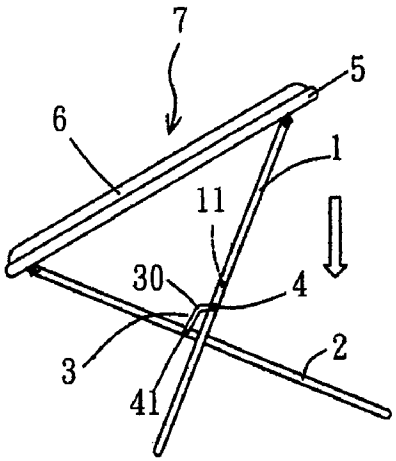
FIG. 10 is a schematic operational view of the foldable chair assembly as shown in FIG. 9.
Figure 9:
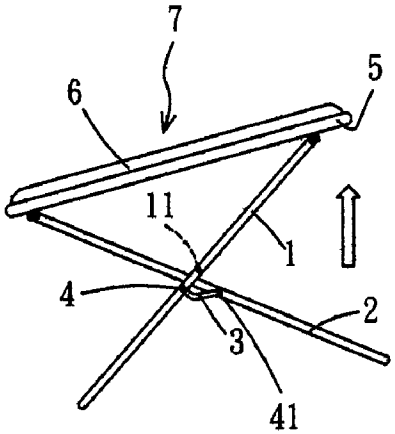
FIG. 9 is a schematic operational view of the foldable chair assembly as shown in FIG. 8.
Figure 8:
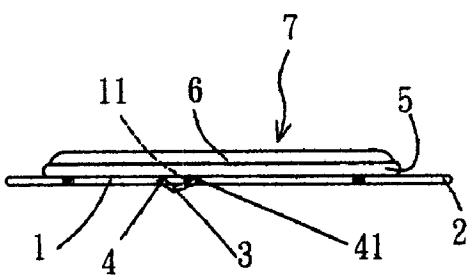
FIG. 8 is a plan folded view of the foldable chair assembly as shown in FIG. 1.

Referring to FIGS. 8–11 with reference to FIGS. 1–7, when the user wishes to expand the foldable chair assembly 7, the support frame 5 is pulled upward to move the first support leg 1 upward, so that the first support leg 1 and the limit rod 11 are moved upward and each of the two resting members 3 are pivoted about the second pin 41 in the clockwise direction to move from the position as shown in FIGS. 8 and 9 to the position as shown in FIG. 10. At this time, each of the two resting members 3 is located above an intersection between the first support leg 1 and the second support leg 2 and is directed upward. Then, the support frame 5 is pushed downward to move the first support leg 1 downward, so that the first support leg 1 and the limit rod 11 are moved downward and each of the two resting members 3 are pivoted about the second pin 41 in the clockwise direction to move from the position as shown in FIG. 10 to the position as shown in FIG. 11, where the limit rod 11 of the first support leg 1 is rested on the mediate portion of the second support leg 2, thereby expanding the foldable chair assembly 7 as shown in FIG. 11. Thus, the first support leg 1 is combined with the second support leg 2 so as to support the support frame 5 and the seat 6 rigidly and stably.

Accordingly, when the foldable chair assembly 7 is disposed at the normally stretched state, each of the two resting members 3 is located above an intersection between the first support leg 1 and the second support leg 2, and the bent portion 30 of each of the two resting members 3 is directed upward. In addition, when the foldable chair assembly 7 is disposed at the folded state, each of the two resting members 3 is located below an intersection between the first support leg 1 and the second support leg 2, and the bent portion 30 of each of the two resting members 3 is directed downward. Further, when the foldable chair assembly 7 is disposed at the normally stretched state, the limit rod 11 of the first support leg 1 is rested on the mediate portion of the second support leg 2, so that the first support leg 1 is combined with the second support leg 2 so as to support the support frame 5 and the seat 6 rigidly and stably. Further, the foldable chair assembly 7 can be folded and expanded easily and conveniently, thereby facilitating the user using the foldable chair assembly 7.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A foldable chair assembly, comprising:

a support frame;

a first support leg having an upper portion pivotally mounted on a bottom of the support frame;

a second support leg having an upper portion pivotally mounted on the bottom of the support frame; and two opposite resting members each pivotally mounted between a mediate portion of the first support leg and a mediate portion of the second support leg; wherein each of the two resting members has a first end pivotally mounted on an inner side of the first support leg by a first pin and a second end pivotally mounted on an outer side of the second support leg by a second pin;

each of the two resting members is substantially V-shaped;

the mediate portion of the first support leg is provided with a limit rod rested on the mediate portion of the second support leg, and the limit rod of the first support leg is located above the first pin at the first end of each of the two resting members.

2. The foldable chair assembly in accordance with claim 1, wherein the bottom of the support frame is provided with a plurality of pivot ears for pivoting the upper portion of each of the first support leg and the second support leg by a plurality of pivot pins.

3. The foldable chair assembly in accordance with claim 1, wherein each of the two resting members has a mediate portion formed with a bent portion facing upward and directed toward the upper portion of the first support leg.

4. The foldable chair assembly in accordance with claim 3, wherein when the foldable chair assembly is disposed at a stretched state, each of the two resting members is located above an intersection between the first support leg and the second support leg, and the bent portion of each of the two resting members is directed upward.

5. The foldable chair assembly in accordance with claim 3, wherein when the foldable chair assembly is disposed at a folded state, each of the two resting members is located below an intersection between the first support leg and the second support leg, and the bent portion of each of the two resting members is directed downward.

6. A foldable chair assembly, comprising:

a support frame;

a first support leg having an upper portion pivotally mounted on a bottom of the support frame;

a second support leg having an upper portion pivotally mounted on the bottom of the support frame; and two opposite resting members each pivotally mounted between a mediate portion of the first support leg and a mediate portion of the second support leg; wherein each of the two resting members has a first end pivotally mounted on an inner side of the first support leg by a first pin and a second end pivotally mounted on an outer side of the second support leg by a second pin;

the mediate portion of the first support leg is provided with a limit rod rested on the mediate portion of the second support leg; and the limit rod of the first support leg is located above the first pin at the first end of each of the two resting members, wherein each of the first support leg and the second support leg is substantially U-shaped.

7. A foldable chair assembly, comprising:

a support frame;

a first support leg having an upper portion pivotally mounted on a bottom of the support frame;

a second support leg having an upper portion pivotally mounted on the bottom of the support frame; and two opposite resting members each pivotally mounted between a mediate portion of the first support leg and a mediate portion of the second support leg, wherein each of the two resting members has a mediate portion formed with a bent portion facing upward and directed toward the upper portion of the first support leg, wherein when the foldable chair assembly is disposed at a folded state, each of the two resting members is located below an intersection between the first support leg and the second support leg, and the bent portion of each of the two resting members is directed downward.

8. The foldable chair assembly in accordance with claim 7, wherein when the foldable chair assembly is disposed at a stretched state, each of the two resting members is located above an intersection between the first support leg and the second support leg, and the bent portion of each of the two resting members is directed upward.

9. The foldable chair assembly in accordance with claim 8, wherein the mediate portion of the first support leg is provided with a limit rod rested on the mediate portion of the second support leg when the foldable chair assembly is disposed at a stretched state, so that the first support leg is combined with the second support leg so as to support the support frame.

* * * * *